US006070768A

United States Patent [19]

Collin et al.

[11] Patent Number: 6,070,768

[45] Date of Patent: Jun. 6, 2000

[54] APPARATUS FOR SUPPLYING ADHESIVE TO A PASTER

[75] Inventors: Jens Collin; Nikolaos Georgitsis; Martin Hoy, all of Hamburg, Germany

[73] Assignee: Topack Verpackungstechnik GmbH, Germany

[21] Appl. No.: 09/188,167

[22] Filed: Nov. 9, 1998

[30] Foreign Application Priority Data

Nov. 7, 1997 [DE] Germany ..... 197 49 165

[51] Int. Cl.[7] ..... B67D 5/40; B65B 3/00

[52] U.S. Cl. ..... 222/377; 222/464.7; 141/356

[58] Field of Search ..... 222/464.1, 464.7, 222/464.5, 382, 377; 141/356

[56] References Cited

U.S. PATENT DOCUMENTS

| | | | |
|---|---|---|---|
| 904,092 | 11/1908 | Schneider | 141/356 |
| 1,317,620 | 9/1919 | Diehl . | |
| 2,874,734 | 2/1959 | Luckock et al. | 141/356 |
| 3,636,976 | 1/1972 | Hansel | 222/464.7 |
| 4,239,131 | 12/1980 | Emert et al. | 222/377 |
| 4,253,490 | 3/1981 | Hansel | 222/464.1 |
| 4,724,983 | 2/1988 | Claasen . | |
| 4,811,863 | 3/1989 | Claasen . | |
| 5,186,365 | 2/1993 | Nolte | 222/464.1 |
| 5,376,272 | 12/1994 | Spearman | 222/464.1 |
| 5,476,198 | 12/1995 | Jouillat et al. | 222/377 |

FOREIGN PATENT DOCUMENTS

| | | |
|---|---|---|
| 2 352 029 | 5/1974 | Germany . |
| 36 36 124 A1 | 5/1988 | Germany . |
| 08131930 | 5/1996 | Japan . |
| 08196973 | 8/1996 | Japan . |

*Primary Examiner*—Kevin Shaver
*Assistant Examiner*—Keats Quinalty
*Attorney, Agent, or Firm*—Venable; George H. Spencer; Robert Kinberg

[57] ABSTRACT

The pot of a paster, such as a paster which can apply a flowable adhesive to a series of coherent blanks or to successive discrete blanks in a cigarette packing machine, receives a suitable adhesive from the discharge end of a suction nozzle. The latter has an intake end which can be introduced into supplies of adhesive in successive vessels of a series of two or more vessels. The suction nozzle carries a container which is at least partially filled with adhesive while the intake end of the nozzle draws adhesive from a vessel, and the thus at least partially filled container supplies adhesive to the intake end of the nozzle during transfer of the nozzle from an emptied vessel into a filled vessel. This ensures that the nozzle can supply adhesive to the paster while its intake end dips into the supply of adhesive in a vessel as well as while the intake end is being advanced from an emptied vessel into an at least partially filled vessel.

20 Claims, 2 Drawing Sheets

APPARATUS FOR SUPPLYING ADHESIVE TO A PASTER

CROSS-REFERENCE TO RELATED CASES

This application claims the priority of German patent application Serial No. 197 49 165.0 filed Nov. 7, 1997. The disclosure of the German patent application, as well as that of each patent mentioned in the specification of the present application, is incorporated herein by reference.

BACKGROUND OF THE INVENTION

The present invention relates to improvements in apparatus for supplying flowable substances from one or more sources to one or more consumers. More particularly, the invention relates to improvements in apparatus which can be utilized with advantage to replenish or to maintain at least substantially constant the supplies of a flowable substance in the tanks, pots and/or other suitable receptacles in pasters and/or other types of machines wherein the supply of a continuously or intermittently consumed flowable material must be replenished, either continuously or at regular or irregular intervals, e.g., depending upon the requirements of one or more consumers.

Typical examples of consumers of flowable materials are so-called pasters which are utilized in machines for packing cigarettes or other rod-shaped smokers' products, e.g., to apply a suitable adhesive (such as hotmelt) to selected portions of discrete or coherent blanks which are to be converted into packets (e.g., the so-called hinged lid packets or soft packets), cartons or other types of enclosures. The blanks can be made of or can contain metallic foil, plastic foil, cardboard, pasteboard, paper or the like.

It is known to replenish the supply of an adhesive in the tank or pot of a paster by resorting to a suction nozzle having an intake end which draws adhesive from successive vessels and delivers a stream of adhesive to the tank or pot (hereinafter called tank) of the paster. Such apparatus operate satisfactorily as long as the intake end of the nozzle dips into a dwindling supply of adhesive in a vessel. However, problems can (and often to) arise when the supply of adhesive in a first vessel is exhausted or is depleted below a minimum acceptable level, i.e., when the intake end of the nozzle must be withdrawn from such (empty or nearly empty) vessel to be introduced into the supply of adhesive in another vessel. Thus, if the delivery of adhesive to a consumer (such as a paster in a cigarette packing machine) is interrupted for a certain interval of time, the machine begins to turn out defective products (such as cigarette packets or cartons of cigarette packets) or is automaticallly brough to a halt. This can entail huge losses in output, especially if the adhesive consuming machine forms part of a full production line, e.g., a production line employing one or more cigarette makers, one or more filter rod makers, one or more filter tipping machines, one or more makers of cigarette packets, one or more carton filling machines, and so forth.

For example, if the supply of adhesive in a vessel is exhausted while the pump which is connected with the suction nozzle continues to draw fluid by way of the suction intake of the nozzle, the latter supplies a column of air in lieu of a continuous stream or flow of adhesive. Such situation can arise while the production line is in actual use, e.g., as a result of exhaustion of the supply of adhesive in a battery or another group of vessels which serve to supply adhesive to the suction intake of the nozzle serving to supply adhesive to the tank or tanks of one or more pasters. A consequence of unsatisfactory operation of the adhesive supplying or replenishing system is that the entire production line must be brought to a halt in order to remove the rejects, to evacuate air from the passage or passages defined in part by one or more suction nozzles, and to reestablish a supply of adhesive-containing vessels.

OBJECTS OF THE INVENTION

An object of the invention is to provide a novel and improved apparatus which can deliver a continuous stream of a flowable substance (such as an adhesive) even while the intake end of the suction nozzle does not dip into a standard supply of flowable substance.

Another object of the invention is to provide a novel and improved method of preventing undesirable interruptions of the delivery of a flowable substance to one or more consumers, such as one or more pasters in the packing and/or wrapping units of production lines which turn out packets, cartons or other receptacles containing cigarettes or other rod-shaped smokers' products.

A further object of the invention is to provide an apparatus which renders it possible to lenghten the intervals between the withdrawal of the intake end of a suction nozzle or the like from an empty or practically empty vessel for a flowable substance and the introduction (such as immersion or dipping) of the intake end into flowable material which is confined in a filled or practically filled vessel.

An additional object of the invention is to provide a novel and improved suction nozzle for use in the above outlined apparatus.

Still another object of the invention is to provide a machine or production line which embodies or cooperates with one or more novel apparatus of the above outlined character.

A further object of the invention is to provide the above outlined apparatus with a mobile source of flowable substance (such as an adhesive substance) which ensures that relatively short or even longer-lasting separations of a suction nozzle from a standard source of a flowable substance do not necessitate an interruption of the operation of a machine or production line employing one or more consumers for a readily flowable liquid or even a highly adhesive or even highly viscous adhesive or other flowable substance.

Another object of the invention is to reduce the likelihood of penetration of air into conduits which are designed for the confinement and conveying of a fluid other than a gaseous fluid.

An additional object of the invention is to reduce the number of rejects in cigarette packing machines and/or other machines for the confinement of rod-shaped and/or other products of the tobacco processing industry in soft packets, hinged lid packets, cartons and/or other types of containers.

Still another object of the invention is to provide a novel and improved combination of one or more pasters and an apparatus for the delivery of an adhesive to such paster or pasters.

A further object of the invention is to provide a simple, compact and inexpensive paste supplying apparatus which can be utilized in existing cigarette making and/or packing machines as a superior substitute for heretofore known and utilized paste supplying apparatus.

SUMMARY OF THE INVENTION

One feature of the present invention resides in the provision of an apparatus for drawing a flowable substance (such as an adhesive and hereinafter called adhesive for short) from at least two vessels which contain supplies of adhesive. The improved apparatus comprises a suction nozzle having an intake end which is insertable into one of at least two vessels to draw paste from the supply in the one vessel with attendant depletion of the supply in the one vessel. The intake end of the suction nozzle is arranged to be withdrawn from the one vessel when the supply of adhesive in the one vessel is depleted to a predetermined level (e.g., to zero level). The apparatus further comprises a container which is movable with the intake end of the suction nozzle into the other of the at least two vessels. The container is arranged to be at least partially filled with adhesive concomitantly with insertion of the intake end of the suction nozzle into the undepleted supply of adhesive in the one vessel, and the container communicates with the intake end to supply adhesive to the suction nozzle at least during an interval which elapses between the withdrawal of the intake end of the suction nozzle from the one vessel and the insertion of the the intake end into the supply of adhesive in the other of the at least two vessels.

The intake end can be constituted by a lower end of the suction nozzle, and such nozzle further comprises at least one further end which can constitute an outlet for the adhesive entering the nozzle by way of the intake end. The vessels are preferably designed in such a way that each vessel has an open top for insertion of the intake end of the suction nozzle into and for withdrawal of the intake end from the supply of adhesive in the respective vessel.

The container has at least one inlet for the admission of adhesive from a supply of adhesive in response to at least partial immersion of the container into the supply of adhesive in that vessel which is in the process of receiving the intake end of the suction nozzle. The arrangement can be such that the container is fully immersible into the supply of adhesive in at least one of the at least two vessels, namely in the vessel which is in the process of supplying adhesive to the intake end of the suction nozzle.

The arrangement can be such that the intake end of the suction nozzle is immersible directly into the supply of adhesive in either of the at least two vessels. Alternatively, the intake end of the suction nozzle can be confined in the container and is then arranged to draw adhesive from a selected one of the at least two vessels by way of the container while the container is at least partially immersed in the supply of adhesive in the selected vessel.

The apparatus can further comprise means for sealing the intake end of the suction nozzle from the container while the intake end is in the process of drawing adhesive from the supply of adhesive in one of the at least two vessels. The sealing means can form part of the suction nozzle.

Each vessel has a flat or otherwise configurated (e.g., recessed) bottom wall. The nozzle is preferably elongated and the container can at least partially surround and is preferably movable longitudinally of the nozzle in response to movement of the intake end of the nozzle toward and into abutment with the bottom wall of a vessel. As already mentioned hereinabove, the lower end of the suction nozzle can constitute the suction intake end, and such apparatus can further comprise one or more coil springs and/or other suitable means for yieldably biasing the container to a predetermined position relative to the suction nozzle; the biasing means can be arranged to yield and to permit the intake end of the nozle to move relative to the container while the intake end of the nozzle moves in a vessel toward abutment with the respective bottom wall.

The container can be designed in such a way that its capacity to confine a body of adhesive is variable. Such container can at least partially surround the intake end of the suction nozle, and the intake end is movable into and away from abutment with the bottom walls of the vessels. The capacity of the container can decrease in response to a movement of the intake end of the suction nozzle above and away from the bottom wall of a selected vessel of the at least two vessels. The apparatus which embodies the just discussed container can further comprise resilient means for moving the container relative to the suction nozzle in response to movement of the intake end of the nozzle above and away from the bottom wall of a selected vessel. For example, the container can comprise a collapsible frame (e.g., a frame resembling that of an umbrella) and a deformable wall which is carried by the frame. The frame can expand to at least partially overlie the bottom wall of a selected vessel when the intake end of the suction nozzle abuts the bottom wall of the selected vessel. The container can further comprise resilient means for partially collapsing the frame toward and around the intake end of the suction nozzle in response to movement of the intake end of the nozzle above and away from abutment with the bottom wall of the selected vessel.

If the bottom walls of the vessels are provided with recesses which receive portions of the respective supplies of adhesive, the intake end of the suction nozzle is preferably movable downwardly toward and upwardly away from from the bottom walls of the selected vessels. Furthermore, the container can be designed and dimensioned and mounted in such a way that it is at least partially received in the recess of a bottom wall which is adjacent the intake end of the suction nozzle. The container can surround the intake end of the nozzle; for example, the dimensions of the intake end of the nozzle and of the container can be selected in such a way that the container spacedly surrounds the intake end of the suction nozzle.

The novel features which are considered as characteristic of the instant invention are set forth with requisite particularity in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings showing three presently preferred embodiments of the improved apparatus.

DESCRIPTION OF PREFERRED EMBODIMENTS

Figure 1:
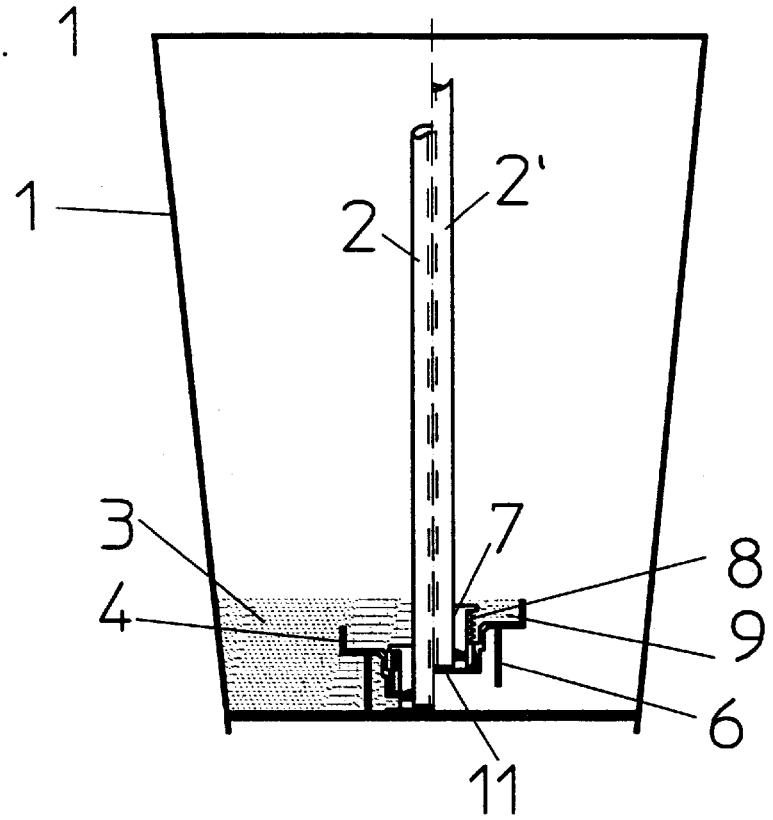
FIG. 1 is a schematic partly elevational and partly sectional view of an apparatus which embodies one form of the invention, the left-hand half of the Figure showing the apparatus in a position it assumes while the intake end of the suction nozzle dips into a supply of flowable material in a vessel having a flat bottom wall and the right-hand half of this Figure showing the suction nozzle and the container in positions they assume when the supply of flowable material in the vessel receiving the intake end of the nozzle and the container is at least partially exhausted.
Figure 2:
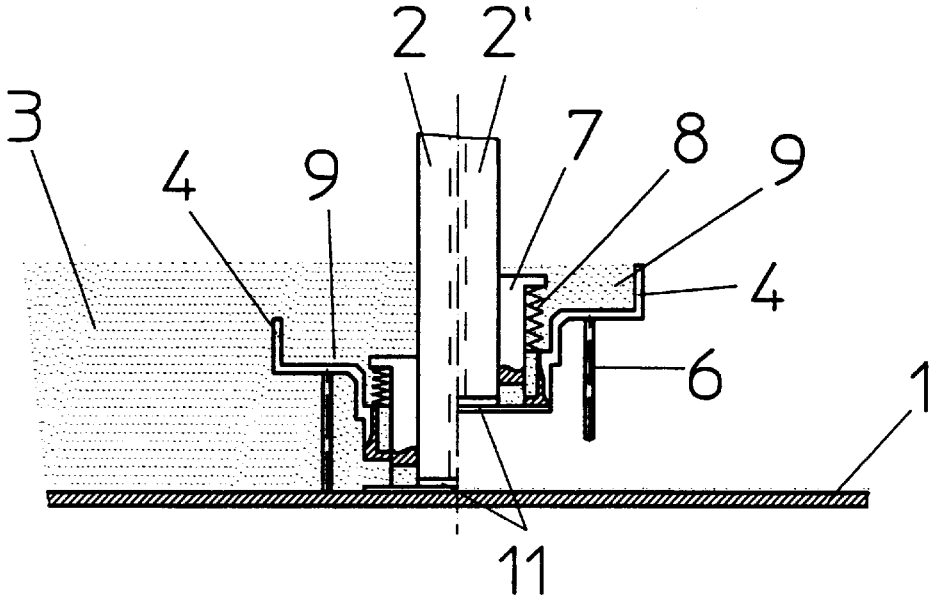
FIG. 2 is an enlarged partly elevational and partly sectional view of the structure shown in the is lower part of FIG. 1.

FIGS. 1 and 2 illustrate the relevant details of an apparatus which embodies one form of the invention and serves to transfer a stream or flow of flowable substance 3 (such as an adhesive (e.g., a hotmelt) and hereinafter referred to as adhesive for short) from a battery of two or more at least partially filled vessels 1 into the tank (not shown) of a paster or any other consumer of adhesive. For example, the consumer can constitute a so-called G90 parceller which confines groups of normally ten cigarette packets in so-called cartons, a so-called B90 cigarette pack boxer which converts discrete blanks into cartons, or a so-called COMPAS 500 packer which serves to turn out so-called bottom fold soft cup cigarette packets. All of the just enumerated machines are distributed by the assignee of the present application; such machines are but a few examples of consumers which can receive adhesive from apparatus embodying the present invention.

The left-hand halves of FIGS. 1 and 2 illustrate a portion of a vessel 1 which is partially filled with adhesive 3, i.e., which contains (or still contains) an adequate quantity of adhesive to enable the improved apparatus to withdraw a continuous stream of adhesive and to convey such stream into the tank or pot or another suitable receptacle of a paster. The right-hand halves of FIGS. 1 and 2 show a portion of a vessel 1 wherein the supply of adhesive has been depleted to a predetermined minimum acceptable level (e.g., to zero level). Furthermore, the right-hand halves of FIGS. 1 and 2 show an elongated suction nozzle 2 of the improved apparatus in an intermediate position 2', namely during withdrawal (such as lifting) from the vessel 1 (for example, during movement above and away from the bottom wall and through the open top of the emptied vessel). It is to be borne in mind that it is equally possible to effect a removal of the nozzle 2 from the vessel 1 by moving the nozzle upwardly while the vessel is moved downwardly or by moving the vessel downwardly while the nozzle remains stationary.

The nozzle 2 has a lower end which constitutes an intake end and receives adhesive 3 from the supply in the vessel 1 while the suction ports 11 of the nozzle are immediately or at least closely adjacent the bottom wall of the vessel shown in the left-hand portions of FIGS. 1 and 2. The flow of adhesive 3 up the nozzle 2, through the outlet or outlets (e.g., at the upper end) of such nozzle, and into the tank of a paster is initiated and maintained by a standard suction pump the construction and the exact mode of operation of which form no part of this invention; therefore the pump is not shown in the drawings.

The intake (lower) end of the suction nozzle 2 is spacedly surrounded by an annular sleeve 4 having downwardly projecting extensions or legs 6 which abut the bottom wall of the vessel 1 during the last stage of downward movement of the nozzle toward the lower end position shown in the left-hand halves of FIGS. 1 and 2. The sleeve 4 is movable axially of the intake end of the nozzle 2 (and/or vice versa) against the opposition of one or more yieldable energy storing resilient elements 8 each of which reacts against an axially fixed tubular sealing device 7 which surrounds the nozzle. The resilient elements 8 (here shown as coil springs which may but need not be installed in a prestressed condition) yield and permit the intake end of the nozzle 2 to move downwardly relative to the sleeve 4 when the extensions 6 abut the bottom wall of the vessel 1 but the nozzle continues to move downwardly.

The sleeve 4 is of one piece with or is connected to a container 9 which has an open top and serves to receive a predetermined quantity of adhesive 3 during insertion of the intake end of the nozzle 2 into the supply of adhesive in an at least partially filled vessel 1. Such predetermined quantity of adhesive 3 in the container 9 is sealed from the adhesive flowing from the vessel 1 directly into the intake end of the nozzle 2 while the quantity of adhesive in the vessel is still above the aforementioned predetermined minimum acceptable level.

The nozzle 2 has one or more suction ports 11 (e.g., in the form of bores, holes, channels or otherwise configurated openings or passages); such ports serve to admit adhesive 3 from a vessel 1 (refer again to the left-hand halves of FIGS. 1 and 2 ) or from the supply in the container 9 into the intake end of the nozzle. The flow of adhesive 3 from the container 9, through the ports 11 and into the nozzle 2 is possible when the springs 8 are free to dissipate at least some energy (see the right-hand halves of FIGS. 1 and 2 ), namely, when the springs 8 are free to move the parts 4, 6 and 9 downwarly with respect to the member 7 which latter is affixed to the nozzle 2. The situation which is shown in the right-hand halves of FIGS. 1 and 2 develops when the nozzle 2 is in the process of being withdrawn from an empty or practically empty vessel 1 preparatory to introduction into another vessel which is at least partially filled with adhesive 3, namely to an extent which is necessary to ensure that the container is filled with adhesive when the nozzle 2 (upon insertion into the other vessel) assumes relative to the bottom wall of the other vessel a position corresponding to that shown in the left-hand halves of FIGS. 1 and 2. The position 2' is but one of numerous positions which the nozzle 2 assumes while receiving adhesive 3 from the container 9.

The sealing of the ports 11 from the interior of the container 9 is effected by the device 7 against the resistance of the coil springs 8 during downward movement of the nozzle 2 relative to the (already intercepted, i.e., arrested) sleeve 4 and container 9, and the establishent of a path for the flow of adhesive 3 from the interor of the container 9, through the ports 11 and into the intake end of the nozzle 2 is effected by the coil springs 8 when such springs are free to dissipate energy and to move the sleeve 4 and the container 9 downwardly relative to the ascending nozzle 2.

The mechanism for lifting and lowering the suction nozzle 2 with and relative to the sleeve 4 and the container 9 (and/or for moving a vessel 1 up and down relative to the nozzle 2 ) is not shown in FIGS. 1 and 2. Such mechanism can receive signals from a conventional level monitoring detector or sensor (not shown) which can initiate an upward movement of the nozzle 2 and/or a downward movement of the vessel 1 when the supply of adhesive 3 in the vessel has been depleted or has descended to the aforementioned predetermined minimum acceptable level. As already explained hereinbefore, the suction ports 11 are automatically sealed from the interior of the vessel 1, and such ports permit adhesive to flow from the container 9 into the nozzle 2, as soon as the the latter begins to move upwardly relative to the sleeve 4 and container 9. The capacity of the container 9 is selected in such a way that it can supply adhesive to the intake end of the nozzle during the interval which normally elapses between the onset of lifting of the nozzle above the lower end position shown in the left-hand halves of FIGS. 1 and 2, through the intermediate position (2') shown in the right-hand halves of FIGS. 1 and 2, and completed introduction of the intake end into the supply of adhesive which is confined in an at least partially filled (fresh) vessel 1. Basically, the apparatus of the present invention can cooperate with two vessels 1 one of which is being filled while the other is being emptied by the nozzle 2, the one of which is thereupon emptied while the other vessel is being refilled, and so forth. However, it is equally possible to resort to a battery of three or more filled vessels which are being emptied in a predetermined sequence, which are thereupon replaced with a battery of filled vessels, and so on.

The container 9 is filled or refilled in automatic response to introduction of the intake end of the nozzle 2 into an at least partially filled vessel 1 wherein the nozzle assumes a lower end position corresponding to that shown in the left-hand halves of FIGS. 1 and 2. An advantage of the container 9 is that it prevents penetration of air into the nozzle 2 (i.e., into the path for the flow of adhesive 3 into the tank(s) of one or more consumers) during transfer of the intake end of the nozzle from an empty or nearly empty vessel 1 into a vessel which is filled with adhesive or contains a preselected quantity of adhesive above the predetermined minimum acceptable level.

The supply of adhesive 3 in the container 9 is part of the supply of such adhesive in the vessel 1 (reference should be had again to the left-hand halves of FIGS. 1 and 2 ) while the nozzle 2 is maintained in the lower end position, i.e., while the suction ports 11 are located at a level below and are sealed (by the device 7) from the interior of the container 9. In other words, the supply of adhesive 3 in the container 9 is integrated into the supply of adhesive in the vessel 1 as long as the suction ports 11 are free to convey adhesive from the vessel and directly into the intake end of the nozzle.

Figure 3:
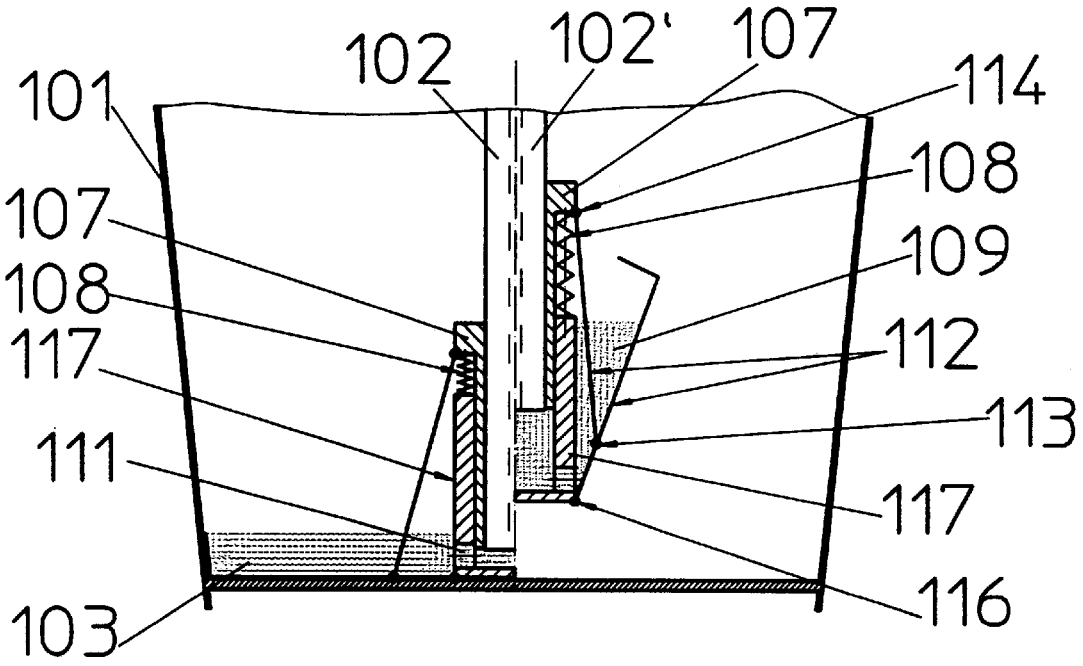
FIG. 3 is a view similar to that of FIG. 1 but showing an apparatus having a different (collapsible) container, the left-hand half of this Figure showing the nozzle in an axial position it assumes while the intake end of the nozzle draws flowable material from the vessel by way of the container and the right-hand portion of this Figure showing the container in a condition it assumes during withdrawal of the intake end of the suction nozzle from an empty or practically empty container.

FIG. 3 illustrates a portion of a modified apparatus. All such parts of this modified apparatus which are clearly analogous to or identical with the parts of the apparatus shown in FIGS. 1 and 2 are denoted by similar reference characters plus 100.

The apparatus of FIG. 3 employs a different container 109 having a collapsible and expandible frame 112 carrying a flexible shell (not referenced) of sheet-like plastic or other suitable material. The frame 112 includes links (in the form of rods, spokes or the like) which are articulately connected to each other and/or to an axially reciprocable tube 117 and/or to the tubular sealing device 107 by suitable joints or pivots 113, 114 and 116. The tube 117 is slidable relative to the sealing device 107 and is biased (downwardly, as viewed in FIG. 3) by one or more energy storing devices including or constituting coil springs 108. Suction ports 111 are provided in the lower end portion of the tube 117; this tube can be said to form part of a composite sealing device which further includes the springs 108 and the part 107 (the latter is affixed to the suction nozzle 102).

In order to assume the operative (lower end) position shown in the left-hand half of FIG. 3, the nozzle 102 must be moved relative to the tube 117 (which already abuts the bottom wall of the vessel 101). This causes the springs 108 to store energy and enables the frame 112 to expand so that some of its links or arms cause the deformable shell of the container 109 to overlie the bottom wall of the vessel 101. In other words, the entire supply of adhesive 103 in the vessel 101 is located at a level above the deformable shell of the container 109. Thus, the intake end of the suction nozzle 102 receives adhesive 103 from the vessel 101 by way of the (expanded) container 109 and the ports 111 in the lower portion of the tube 117.

When the supply of adhesive 103 in the vessel 101 is nearly depleted, the aforementioned level monitoring means initiates an actuation of the mechanism which lifts the nozzle 102 and the container 109 relative to the nearly empty vessel 101. This causes the nozzle 102 to move upwardly through and beyond the intermediate position 102' shown in the right-hand half of FIG. 3. The springs 108 are free to dissipate energy, i.e., the tube 117 slides downwardly relative to the member 107 whereby the frame 112 is caused to assume the collapsed (actually a nearly collapsed) position or condition shown in the right-hand half of FIG. 3. The shell of the container 109 scoops up the remainder of the adhesive 103, and such adhesive can be drawn by the suction nozzle 102 because the suction ports 111 are then sealed from the body of air in the emptied vessel 101 but such ports do establish paths for the flow of adhesive 103 from the container 109 into the intake end of the nozzle 102.

The nozzle 102 constitutes the handle of an inverted umbrella further including the collapsible frame 112, the shell or canopy on the frame, the member 107, the springs 108 and the tube 117.

Figure 4:
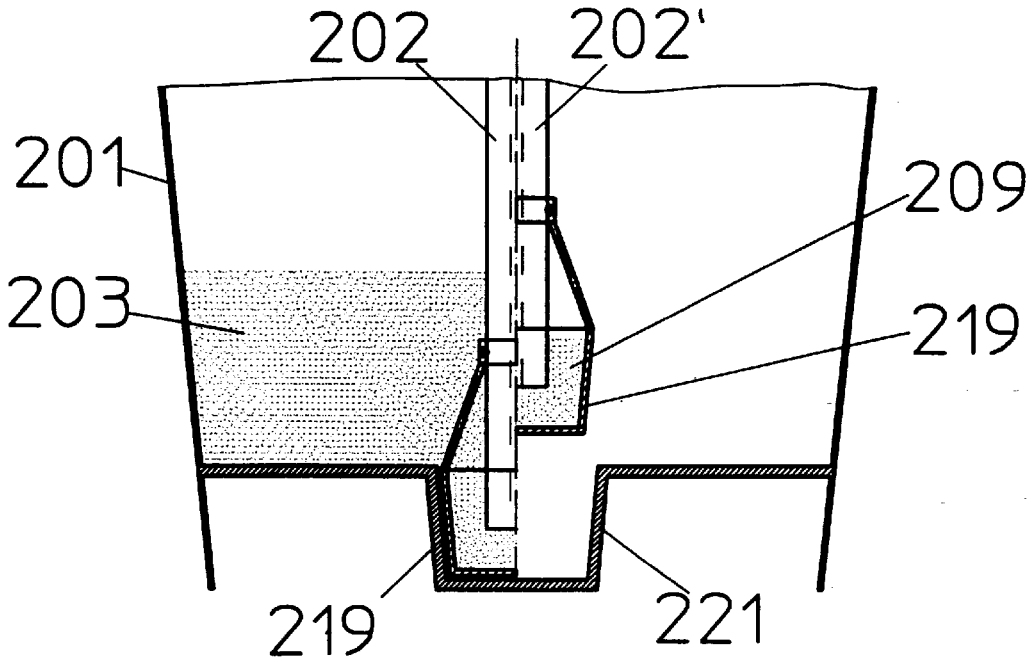
FIG. 4 is a view similar to that of FIG. 3 but showing a further apparatus having a container receivable in a recess provided in the bottom wall of the vessel (see the left-hand portion of this Figure), the right-hand portion of this Figure showing the intake end and the container in intermediate positions during withdrawal from an empty or practically empty vessel.

The vessel 201 which is shown in FIG. 4 has a bottom wall provided with a recess (at 221) which is dimensioned to confine a portion of the supply of adhesive 203 and can receive a lower portion 219 of a container 209. The latter shares all movements of the suction nozzle 202, and its upper portion is foraminous (e.g., perforated) to permit adhesive 203 to fill the lower portion 219 of such container not later than when the lower portion is received in the recess 221 of an at least partially filled vessel 201.

In accordance with a presently preferred embodiment, the container 209 comprises a set of braces (e.g., in the form of rods or the like) with upper ends affixed to the nozzle 202 and with lower ends connected to the cupped adhesive-collecting lower portion 219 which is receivable in the recess 221 of an at least partially filled vessel. The open lower end of the nozzle 202 extends into the interior of the lower portion 219 of the container 209.

When the nozzle 202 is lifted (through and beyond the intermediate position 202' shown in the right-hand half of FIG. 4), the intake end of such nozzle receives adhesive 203 from the lower portion 219 of the container 209. The latter serves to establish a path for the flow of a suitable adhesive 203 from the interior of the vessel 201 (see the left-hand half of FIG. 4) is when the lower portion 219 is confined in the recess 221. This container need not be movable longitudinally of the suction nozzle 202; such construction contributes to simplicity and lower cost of the apparatus which is shown in FIG. 4. The nozzle 2, 102 or 202 can be made of a rigid or of an elastically or otherwise deformable material. All other parts (with the possible exception of the aforementioned shell or canopy of the collapsible container 109 shown in FIG. 3) can be made of a metallic or rigid plastic material.

The drawings show substantially frustoconical vessels 1, 101 and 201. However, it will be readily appreciated that the exact configuration (with the possible exception of the bottom wall of the vessel 201 shown in FIG. 4) of such vessels forms no part of the present invention.

As already explained hereinbefore with reference to FIGS. 1 and 2, the empty and/or filled vessels 1, 101, 201 can be moved relative to the respective containers 9, 109, 209 and/or vice versa. For example, if the nozzle 102 of FIG. 3 is stationary, a filled vessel 101 can be moved upwardly to the position shown in the left-hand half of FIG. 3, and an empty or nearly empty vessel can be moved downwardly away from the lower end (i.e., the suction intake end) of the nozzle 102.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of adhesive supplying apparatus and, therefore, such adaptations should and are intended to be comprehended within the meaning and range of equivalence of the appended claims.

What is claimed is:

1. Apparatus for drawing a flowable substance from at least two vessels which contain supplies of flowable substance, comprising:

a suction nozzle having an intake end insertable into one of the at least two vessels to draw flowable substance from the supply in the one vessel with attendant depletion of the supply, said intake end being arranged to be withdrawn from the one vessel when the supply of flowable substance in the one vessel is depleted to a predetermined level; and a container movable with said intake end from the one vessel into the other of the at least two vessels, said container being arranged to be at least partially filled with flowable substance concomitantly with insertion of said intake end into undepleted supply of flowable substance in the one vessel and said container communicating with said intake end to supply flowable substance to said suction nozzle at least during an interval elapsing between the withdrawal of said intake end from the one vessel and the insertion of said intake end into the supply of flowable substance in the other vessel.

2. The apparatus of claim 1, wherein said flowable substance is an adhesive.

3. The apparatus of claim 1, wherein said suction nozzle has a lower end which constitutes said intake end and a further end constituting an outlet for flowable substance.

4. The apparatus of claim 3, wherein each of the at least two vessels has an open top for insertion of said intake end into and for withdrawal of said intake end from the supply of flowable substance in the respective vessel.

5. The apparatus of claim 1, wherein said container has at least one inlet for the admission of flowable substance from a supply of flowable substance in response to at least partial immersion of said container into the supply of flowable substance in that vessel which is in the process of receiving the intake end of said nozzle.

6. The apparatus of claim 5, wherein said container is fully immersible into the supply of flowable substance in that one of the at least two vessels which is in the process of supplying flowable substance to said intake end.

7. The apparatus of claim 1, wherein said intake end is immersible directly into the supply of flowable substance in either of the at least two vessels.

8. The apparatus of claim 1, wherein said intake end is confined in said container and is arranged to draw flowable substance from a selected one of the at least two vessels by way of said container while the container is at least partially immersed in the supply of flowable substance in the selected vessel.

9. The apparatus of claim 1, further comprising means for sealing said intake end from said container while said intake end is in the process of drawing flowable substance from the supply of flowable substance in one of the a least two vessels.

10. The apparatus of claim 9, wherein said sealing means forms part of said suction nozzle.

11. The apparatus of claim 1 for drawing a flowable substance from vessels having bottom walls, wherein said nozzle is elongated and said container at least partially surrounds and is movable longitudinally of said nozzle in response to movement of said intake end toward and into abutment with the bottom wall of a vessel.

12. The apparatus of claim 11, wherein said nozzle has a lower end constituting said intake end, and further comprising means for yieldably biasing said container to a predetermined position relative to said nozzle, said biasing means being arranged to yield and to permit said intake end to move relative to said container while said intake end moves in a vessel toward abutment with the respective bottom wall.

13. The apparatus of claim 1 for drawing a flowable substance from vessels having bottom walls, wherein said container has a variable capacity and at least partially surrounds said intake end, said intake end being movable into and away from abutment with the bottom walls of the vessels and the capacity of said container being arranged to decrease in response to a movement of said intake end above and away from the bottom wall of a selected one of the at least two vessels.

14. The apparatus of claim 13, further comprising resilient means for moving said container relative to said nozzle in response to said movement of said intake end above and away from the bottom wall of a selected vessel.

15. The apparatus of claim 13, wherein said container comprises a collapsible frame and a deformable wall carried by said frame, said frame being arranged to expand and to at least partially overlie the bottom wall of a selected vessel when said intake end abuts the bottom wall of the selected vessel.

16. The apparatus of claim 15, wherein said container further comprises resilient means for partially collapsing said frame toward and around said intake end in response to movement of said intake end above and away from abutment with the bottom wall of the selected vessel.

17. The apparatus of claim 1 for drawing a flowable substance from vessels having bottom walls and recesses provided in the bottom walls and arranged to receive portions of the respective supplies of flowable substance, said intake end being movable downwardly toward and upwardly away from the bottom walls of selected vessels and said container being at least partially received in the recess of a bottom wall which is adjacent said intake end.

18. The apparatus of claim 17, wherein said container surrounds said intake end.

19. The apparatus of claim 17, wherein said contaner spacedly surrounds said intake end.

20. The apparatus of claim 17, wherein said container includes a lower portion receivable in the recess of a bottom wall and arranged to collect flowable substance, and an upper portion which is affixed to said nozzle and defines at least one path for the flow of flowable substance between said lower portion and a supply of flowable substance above that recess which receives the lower portion.

* * * * *